US011377925B2

(12) United States Patent
Mueller et al.

(10) Patent No.: US 11,377,925 B2
(45) Date of Patent: Jul. 5, 2022

(54) THROUGH TUBING P AND A WITH BISMUTH ALLOYS

(71) Applicant: ConocoPhillips Company, Houston, TX (US)

(72) Inventors: Dan Mueller, Houston, TX (US); Geir Ove Titlestad, Tananger (NO); David D. Hearn, Houston, TX (US); Curtis G. Blount, Houston, TX (US); Rick D. Watts, Houston, TX (US); Randall S. Shafer, Houston, TX (US); Dale R. Doherty, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 233 days.

(21) Appl. No.: 16/175,090

(22) Filed: Oct. 30, 2018

(65) Prior Publication Data

US 2019/0128092 A1 May 2, 2019

Related U.S. Application Data

(60) Provisional application No. 62/579,001, filed on Oct. 30, 2017.

(51) Int. Cl.
*E21B 29/00* (2006.01)
*E21B 33/13* (2006.01)
*E21B 43/11* (2006.01)

(52) U.S. Cl.
CPC ..... *E21B 33/13* (2013.01); *E21B 29/002* (2013.01); *E21B 43/11* (2013.01)

(58) Field of Classification Search
CPC ..... E21B 33/13; E21B 33/138; E21B 33/00; E21B 29/00
See application file for complete search history.

(56) References Cited

U.S. PATENT DOCUMENTS 4,429,746 A * 2/1984 Allard ..... E21B 33/05 166/156
6,474,414 B1 11/2002 Gonzalez et al.
(Continued)

FOREIGN PATENT DOCUMENTS

WO 2011151271 A1 12/2011
WO 2013085621 A1 6/2013
WO 2014096858 A2 6/2014

OTHER PUBLICATIONS

International Search Report, PCT/US2018/058228, dated Jan. 18, 2019, 2 pgs.

*Primary Examiner* — Robert E Fuller
*Assistant Examiner* — Lamia Quaim
(74) *Attorney, Agent, or Firm* — ConocoPhillips Company

(57) ABSTRACT

Method of plugging a hydrocarbon well by a through-tubing technique are described. The method allows the tubing to be left in place. Only a short (<2 m) section is cut, milled, perforated, ruptured and expanded, or combinations thereof. A blocking device is sent downhole to block a bottom of the plug section, and bismuth alloy pellets dropped onto the blocking device. A heater is deployed to melt the bismuth alloy pellets. Next, the alloy liquid is allowed to cool and solidify. During solidification, the alloy expands and fills the section of well to be plugged or a portion thereof. Once primary and secondary barriers are in place, the well can be closed and the Christmas tree removed. A rock-to-rock plug can be set by removing or partially removing the tubular and outer casing, or just inner casing/tubulars can be removed if the exterior cement and casing are of sufficient quality.

24 Claims, 11 Drawing Sheets

(56) References Cited

U.S. PATENT DOCUMENTS

| | | | | |
|---|---|---|---|---|
| 6,478,088 | B1 * | 11/2002 | Hansen | E21B 33/134 166/285 |
| 6,664,522 | B2 | 12/2003 | Spencer | |
| 6,679,328 | B2 | 1/2004 | Davis et al. | |
| 6,828,531 | B2 | 12/2004 | Spencer | |
| 6,923,263 | B2 | 8/2005 | Eden et al. | |
| 7,152,657 | B2 | 12/2006 | Bosma et al. | |
| 7,290,609 | B2 | 11/2007 | Wardlaw et al. | |
| 2004/0040710 | A1 | 3/2004 | Eden et al. | |
| 2005/0109511 | A1 | 5/2005 | Spencer | |
| 2006/0144591 | A1 * | 7/2006 | Gonzalez | E21B 33/13 166/277 |
| 2010/0006289 | A1 | 1/2010 | Spencer | |
| 2011/0220357 | A1 * | 9/2011 | Segura | E21B 29/005 166/298 |
| 2012/0298359 | A1 | 11/2012 | Eden et al. | |
| 2013/0087335 | A1 | 4/2013 | Carragher et al. | |
| 2013/0333890 | A1 | 12/2013 | Dagenais et al. | |
| 2014/0326470 | A1 * | 11/2014 | Tinnen | E21B 29/04 166/385 |
| 2015/0053405 | A1 | 2/2015 | Bakken | |
| 2015/0345248 | A1 | 12/2015 | Carragher | |
| 2015/0354306 | A1 * | 12/2015 | Fuller | E21B 17/1078 166/285 |
| 2015/0361759 | A1 * | 12/2015 | Kjorholt | E21B 33/13 166/286 |
| 2015/0368542 | A1 | 12/2015 | Carragher | |
| 2016/0010423 | A1 * | 1/2016 | Myhre | E21B 33/13 166/285 |
| 2016/0145962 | A1 | 5/2016 | Carragher | |
| 2018/0094503 | A1 * | 4/2018 | Wardley | E21B 29/00 |
| 2018/0094504 | A1 | 4/2018 | Hearn et al. | |
| 2018/0148991 | A1 | 5/2018 | Hearn et al. | |
| 2018/0216437 | A1 | 8/2018 | Shafer | |

* cited by examiner

THROUGH TUBING P AND A WITH BISMUTH ALLOYS

PRIOR RELATED APPLICATIONS

This application is a non-provisional application which claims benefit under 35 USC § 119(e) to U.S. Provisional Application Ser. No. 62/579,001 filed Oct. 30, 2017, entitled "THROUGH TUBING P&A WITH BISMUTH ALLOYS," which is incorporated herein in its entirety.

FIELD OF THE INVENTION

The invention relates to methods, systems and devices for plug and abandonment operations to shut down a well or a portion thereof.

BACKGROUND

The decision to plug and abandon a well or field is often based on simple economics. Once production value drops below operating expenses, it is time to consider abandonment, even if considerable reserves remain. It is also useful to plug and abandon a well to use an existing slot to sidetrack into new payzones. This process is known as "slot recovery" and is very cost effective compared to drilling a new horizontal well. Consequently, plug and abandonment (P&A) is an inevitable stage in a lifespan of a well.

In a typical P&A operation, operators remove existing completion hardware, set plugs and squeeze cement into an annulus at specified depths across producing and water-bearing zones to act as permanent barriers to pressure from above and below. Operators remove the wellhead last. One of the main problems in any cementing procedure is contamination. Poor mud-removal in areas where the cement is to be set can give rise to channels through the plug caused by the drilling fluid. To avoid this, a spacer is often pumped before and after the cement slurry to wash the hole and to segregate the drilling fluid and the cement from each other.

Channeling is another problem that can occur during cementing. It is typically caused by inadequate use of centralizers which leads to eccentricity of the tubing. When this happens, cement will have more difficulty moving on the narrow side of the tubing. The narrow space is more susceptible to channel, and even when channeling does not occur, the cement will tend to be thinner on that side. Cement shrinkage can also cause gaps between the plug and casing, and between the plug and reservoir wall. Although use of cement is widespread, it is susceptible to early failure, particularly if contaminated by drilling or other fluids. Other materials have been investigated for use as plugging material. These include various resins, geopolymeric materials, geopolymers, and the like.

Today, there are increasing demands that operators remove sections of casing to allow a plug that is continuous across the entire borehole to be set in a configuration often referred to as "rock-to-rock." Since cement or other plugging material should reach the formation wall, typical procedure involved pulling the tubing, milling the casing, and removing swarf before spotting the cement. However, this procedure can require multiple trips downhole and allow accumulation of swarf in low flow zones.

SUMMARY

The present disclosure provides systems, methods and devices for a through tubing P&A operation. The present invention describes ways to remove a short region of tubing and/or casing and access the plugging interval. The present invention may also be useful for non-abandonment plugging applications such as slot recovery, temporary abandonment, and the like.

The present method is considered a "through tubing" method since at least a portion of the tubing is left in place for the P&A operation. However, the term "through tubing" does not mean that no tubing may be removed at the section to be plugged. Nevertheless, the term "through tubing" will be used because the entirety of the tubing need not be pulled out of the well prior to the P&A operation.

Typically, in conventional (non-"through tubing" P&A), the tubing is pulled and the well is secured with barriers, plugs, fluid, or other methods and a Christmas tree is replaced with a blowout preventer. This blowout preventer will need to be large (~13⅝ inches) which in turn requires expensive modular offshore drilling unit (MODU) offshore well installation.

An advantage of through tubing P&A is that the large blowout preventer (BOP) is not needed because the well can be fully secured by permanent plugs in the wellbore before removing the Christmas tree. Because use of MODU is avoided, cost is kept down significantly. On some installations, two wells can be plugged at the same time provided there is sufficient room for two or more P&A operations.

According to some embodiments, one or more multiple concentric tubing strings can be ruptured and expanded. After rupture and expansion, a base plug or other blocking device may be set at the bottom of the cavity to capture or hold bismuth alloy pellets. This plug or block need not be perfect because the bismuth alloy (once converted to liquid) will quickly cool and block any gaps between the blocking device and rock wall and tubular remnants. Thus, only a small amount of liquid alloy will be lost.

A low melt alloy (may be combined with additional cement or resin or geopolymer plug) is then used to set a cast-in-place abandonment plug according to regulations and/or as wellbore dictates. Low melt alloys or fusible alloys have low melting temperatures and can expand when solidifying from a liquid to a solid depending on the product. Bismuth alloys are desirable as cast-in-place abandonment plug material because they expand upon going from liquid to solid state (bismuth expands 1-3.32% on solidification). This allows the alloys to precisely conform to its surroundings. In a cast-in-place abandonment plug, the expansion means that the plug will expand to firmly contact the reservoir walls, as well as any metal casing or tubing, and provide a tight seal. Bismuth also has very low toxicity for a heavy metal. Unlike cement, these liquid alloys do not mix with other fluids. Consequently, channeling which is common in cement plugs can be avoided or significantly reduced.

The bismuth alloys may be released downhole as solid pellets or other convenient shapes. In its liquid form, the bismuth alloy has a water-like viscosity, easily penetrating and conforming to irregularities downhole. Because of the properties described herein, bismuth alloys can typically penetrate deeper into the reservoir as compared to cement. The bonding should also be tighter yet the final plug will be ductile. The high quality of the material and its bond allows a shorter length to be plugged, thus even if cutting or milling steps are performed, the interval is much shorter than typical, greatly saving time and cost.

If a section of a well to be plugged is not cemented or is only poorly cemented, access to the annular space between the tubing and casing and/or between the outermost casing and reservoir is needed so that the abandonment plug can be placed right up the formation for a rock-to-rock plug. This can be accomplished by one or more steps as described herein, including rupture and expansion, perforation, cutting, and milling. There may be other compatible of either removing these tubulars, or rupturing them sufficiently for access.

If the well at the section to be plugged is adequately cemented, rupture and expansion may be avoided and the exterior casing and annular cement left intact. For example, milling, cutting or other compatible methods can be performed to remove a (1-5 meters or 2-4 meters) section of the nested tubulars. After removal of the section, a cast-in-place bismuth alloy abandonment plug can be deployed as described herein.

In one or more embodiments, the abandonment plug can be further capped with cement or another material to meet regulatory requirements, or as otherwise needed. A cement plug can also be set under the cast-in-place bismuth abandonment plug. Alternatively, or in addition to, the bismuth plug can also be combined with a resin plug or a geopolymer plug, or combinations thereof. With the use of the 1-5 m or 2-4 m metal plugs, no further cement cap is likely necessary.

If needed, quality of the abandonment plug can be assessed by drilling a small hole to allow access for logging tools. Once assessment is complete, the small hole can be plugged with bismuth alloys, cement/resin, or something similar.

A cement bond log (CBL) can be used as one assessment on the integrity of the cement job. It can show whether the cement (or resin or metal) is adhering solidly to the outside of the casing. The log is typically obtained from a sonic-type tool. Newer versions of CBL include cement evaluation logs, which along with accompanying processing software, can give detailed, 360-degree representations of the integrity of the cement job. In this case, the CBL is used to determine that a good connection between the abandonment plug and the formation walls. A CBL can be generated with a cement bond tool. Cement bond tools measure the bond between casing and the cement placed in the annulus between the casing and the wellbore. The measurement is made by using acoustic (sonic and ultrasonic) tools.

P&A regulations often stipulate that downhole plugs meet certain quality requirements to be considered "permanent." However, it is should be understood that even a permanently plugged and abandoned well may be reopened later for various reasons. Moreover, most if not all plugs will have some degradation over time. Thus, some degree of flexibility in meaning are accommodated by these terms of art.

As used herein, a "blocking device" is any device used to place settable materials (e.g., cement, resin, bismuth alloy, etc.) at the desired depth. The blocking device provides a stable base on which to set the cast-in-place abandonment plug. Suitable blocking devices include baskets, inflatable baskets, plugs, packers and the like. Other suitable blocking devices include cement plugs, barite plugs, sand plugs, resin plugs, and the like. Since the blocking device merely acts as a base for a permanent plug, it does not necessarily have to permanent as a standalone.

As used herein, "tubular" or "tubing" refers generically to any type of oilfield pipe, such as, but not limited to, drill pipes, drill collars, pup joints, casings, production tubings and pipelines. In some cases, the outer one or more tubing sets may be referred to as "casing" or "casings."

As used herein, a "Christmas tree" refers to an assembly connected to the top of a well to direct and control drilling and/or production. Christmas trees can be found in a wide range of sizes and configurations, depending on the type and production characteristics of the well. The Christmas tree also incorporates facilities to enable safe access for well intervention operations, such as slickline, electric wireline or coiled tubing.

As used herein, a "wellhead" refers to the surface termination of a wellbore that incorporates facilities for installing casing hangers during the well construction phase. The wellhead also incorporates a means of hanging the production tubing and installing the Christmas tree and surface flow-control facilities in preparation for the production phase of the well.

As used herein, a "blow out preventer" or "BOP" is a large device with a plurality of valves and fail-safes at the top of a well that may be closed if the drilling crew loses control of formation fluids. BOPs can be operated remotely, allowing a drilling crew to regain control of a reservoir in the event of loss of control.

As used herein "swarf" are the fine chips or coils of metal produced by milling the casing or tubing.

As used herein, a "cutter" is any downhole tube that can be used to cut casing or tubing. A cutter is often used downhole when a tool is stuck to retrieve the tubing string and send down fishing tools. There are several different types of cutters including external cutter, chemical cutter, jet cutter, and the like. An external cutter is a type of cutter that slips over the fish or tubing to be cut. Special hardened metal-cutters on the inside of the tool engage on the external surfaces of the fish. A chemical cutter is usually run on wireline to sever tubing at a predetermined point when the tubing string has become stuck. When activated, the chemical cutter forcefully directs high-pressure jets of highly corrosive material in a circumferential pattern against the tubular wall. The nearly instantaneous massive corrosion of the surrounding tubing wall creates a relatively even cut with minimal distortion of the tubing, aiding subsequent fishing operations.

As used herein, a "perforation tool" cuts small holes or slots in the tubulars. These are typically used to convert a designated region of casing to production use, the plurality of discrete holes allowing ingress of oil. Such tools can also be used herein in the P&A process.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

DETAILED DESCRIPTION

Developed herein is a method of plug and abandonment, which is shown schematically in various embodiments in the figures.

Figure 1C:
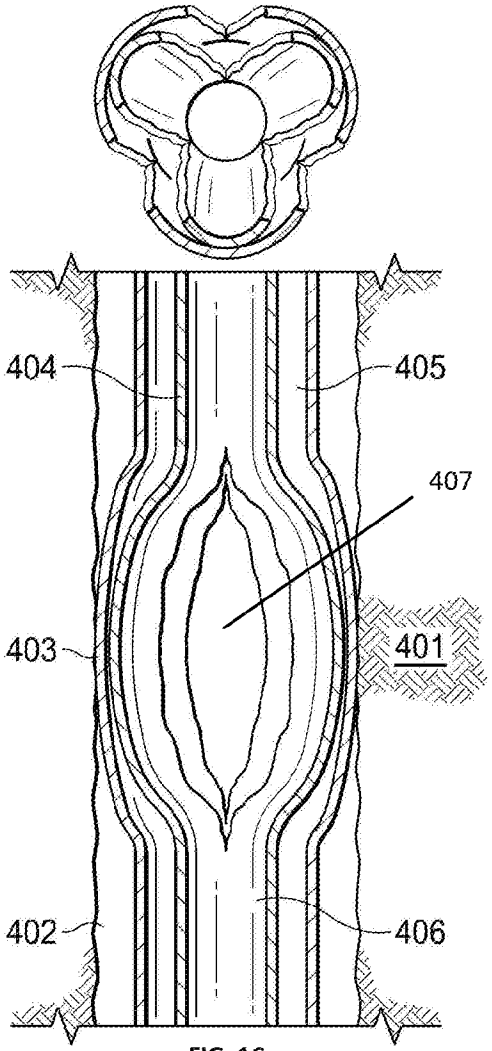
FIG. 1A, FIG. 1B, FIG. 1C, FIG. 1D, FIG. 1E, FIG. 1F, FIG. 1G, FIG. 1H, FIG. 1I, FIG. 1J, FIG. 1K, FIG. 1L, FIG. 1M, FIG. 1N, FIG. 1O, and FIG. 1P show one embodiment of the inventive method wherein the tubing and casing are ruptured and expanded using a casing deformation tool. This embodiment illustrates the optional step FIG. 1D of perforating the remaining casing before setting the alloy plug.
Figure 1B:
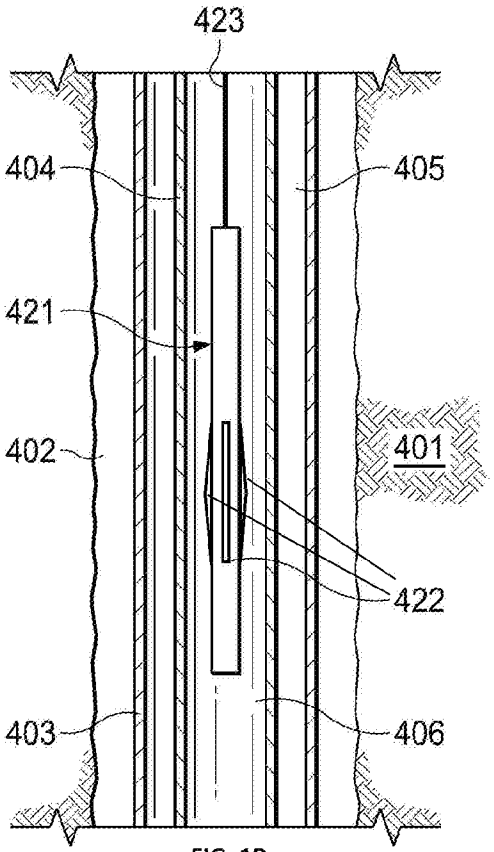
Figure 1A:
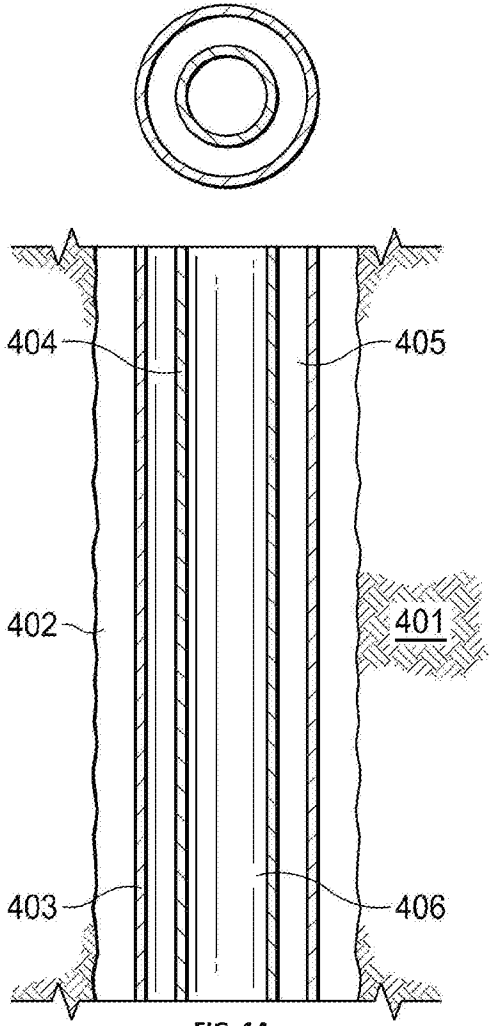

FIG. 1A shows a section of well to be plugged. In FIG. 1A the reservoir is 401, and there is an annular space 402 between outer casing 403 and reservoir 401. This space 402 either lacks cement or lacks quality cement. Production tubing 404 has an internal space 406 and an annular space 405 between the tubing 404 and casing 403.

A wireline lubricator is placed on top the Christmas tree (not shown). The lubricator contains a casing deformation tool 421 having multiple blades 422, suspended from the wireline 423, designed to rupture and expand the tubing and casing (FIG. 1B). In its pre-activated state (FIG. 1A), the casing deformation tool will have a smaller outer diameter so that it can be inserted downhole without removing the Christmas tree. Once activated (FIG. 1B), the casing deformation tool will force blades 422 out of the tool housing, thereby expanding and rupturing the tubing and the casing in the process. As shown in the cross section in the insert panel of FIG. 1C, the tubing has split into sections and pushed out of the way. The casing is also expanded past its yield point, giving access to the annulus surrounding the casing. An expanded cavity 407 is the result.

In this non-limiting embodiment, the casing deformation tool 421 works hydromechanically. The deformation tool has stackable pistons (not shown) that respond to hydraulic pressure to force the blades 422 (3 blades shown) out to rupture and expand tubings and casings. A commercially available casing deformation tool includes the Gator™ perforator System available from Energy Fishing & Rental Services (EFRS). Other compatible casing deformation tools may also be used.

After rupture and expansion of the tubing and casing, an optional wash step may be desirable. Scale, drilling mud, swarf (if present) can be washed using a tool (e.g., jet washer) drawn down on a coil tubing to clean out. It may be desirable to perform this wash later. Bismuth alloy is not miscible with other fluids. Due to its relatively high specific gravity, debris will tend to float out.

Figure 1F:
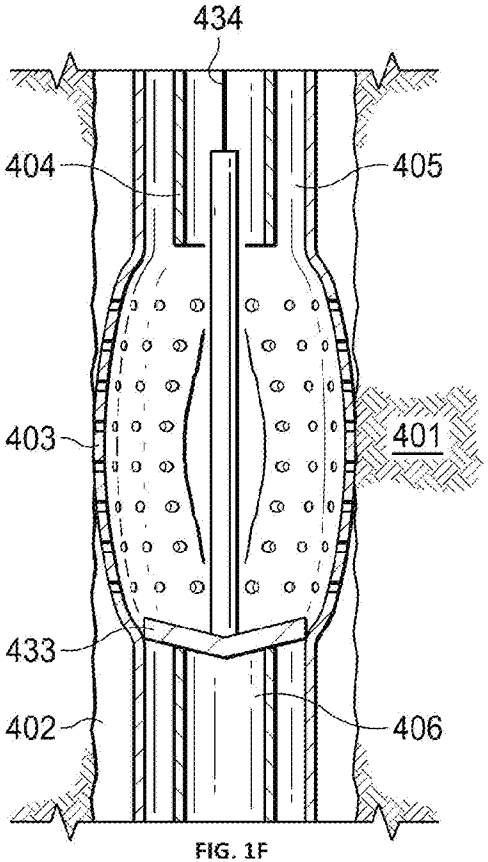

Access to the annular space between the casing and formation can be assessed, by, for example, camera or sonic log. If there sufficient rupture, the casing can also be perforated to give better access to the annulus between casing and formation. FIG. 1D illustrates the result, wherein a perforating tool (not shown) has perforated or jet perforated/cut a number of perforations through the casing.

Figure 1E:
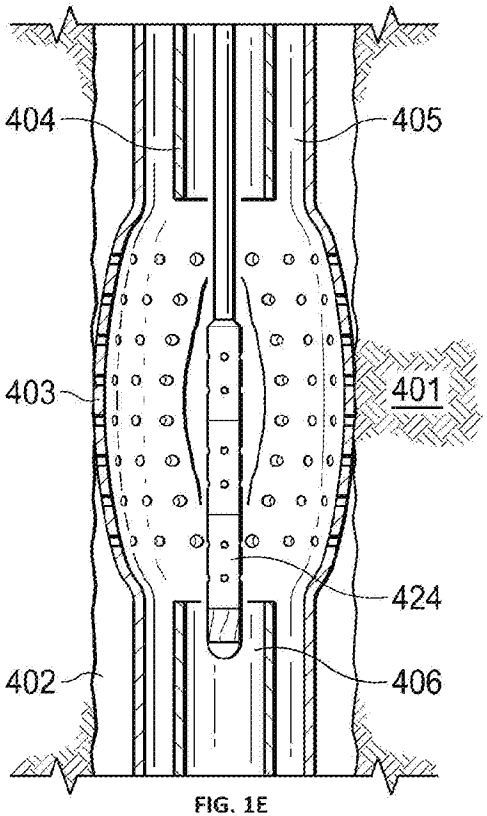
Figure 1D:
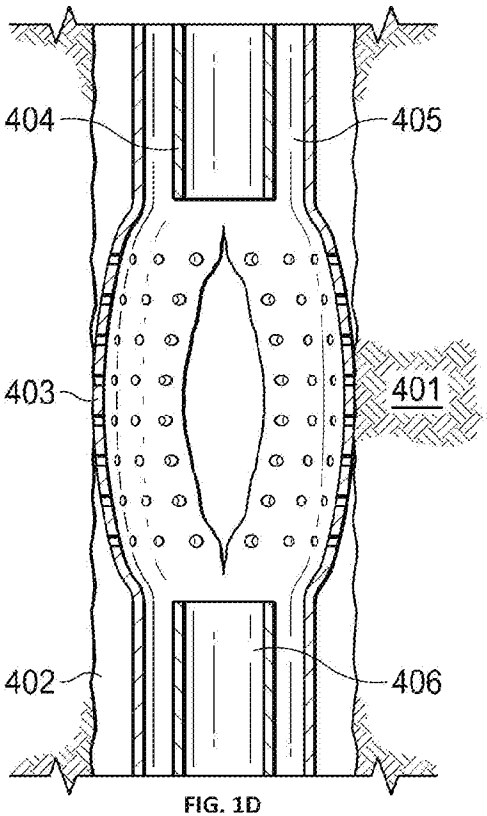
Figure 1I:
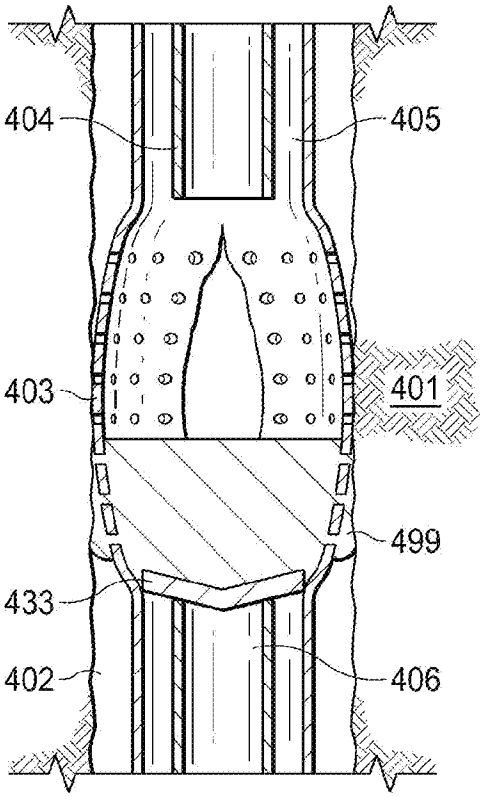

Referring to FIG. 1E, a sonic tool or camera 424 can be used as a downhole probe to determine cavity size and extent of access to the reservoir. This and similar verification steps may be useful initially but may be omitted once sufficient experience has been gained.

A blocking device can then be run and set in the bottom of the cavity to provide a base or bottom for the abandonment plug. This device can be a mechanical device, such as an expandable packer, a pedal basket, or a plug. Alternatively, non-mechanical blocking means, such as a small cement plug could be set or materials such as sand could also be placed therein. In some circumstances, a mechanical device may be preferred over cement and sand plugs (these are susceptible to failure), especially where lighter weight cement is used in fragile formations.

FIG. 1F shows placement of a blocking device, an inflatable basket 433, downhole after being lowered on a wireline 434. Compatible devices include the SlikPak™ Plus system commercially available by TAM International, Inc. This is a battery operated, computerized, inflatable, retrievable bridge plug setting system designed to be run on slickline or electric line. Other suitable devices include the ACE Thru Tubing Umbrella Plug, which firmly anchors into place a "metal petal" umbrella that functions as a cement basket to be utilized as a base for subsequent placement (dumping) of bridging material, cement, or resin.

An abandonment plug can be cast-in-place using a bismuth alloy or other low melt alloy that expands on solidification, preferably at least 2.5%, 2.8%, 3.0% or greater. The alloy can be placed by dropping with a dump bailer or dropping bismuth pellets or chips 436 from the surface (FIG. 1G). The cavity is filled with bismuth pellets 436 to the level desired. If previously mapped, the cavity volume will be known and an appropriate number of pellets can be dumped. Levels can also be confirmed by running wireline. The extra amount of alloy allows radial expansion, thus improving the seal.

Figure 1H:
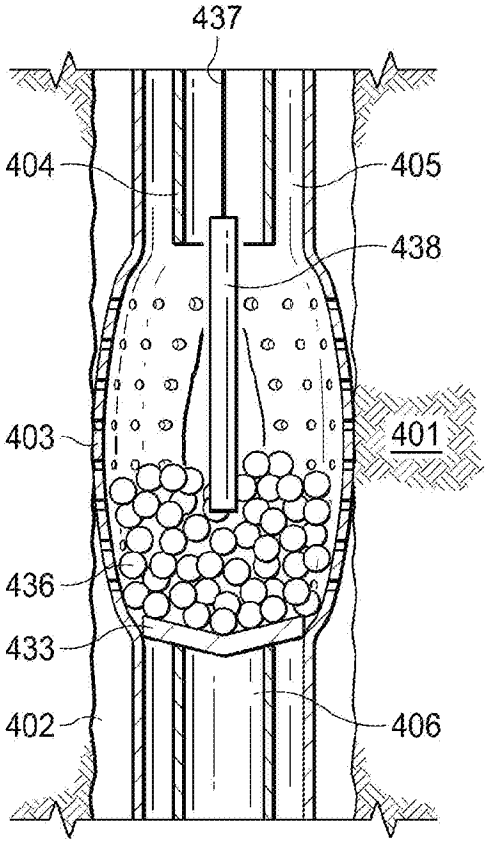
Figure 1G:
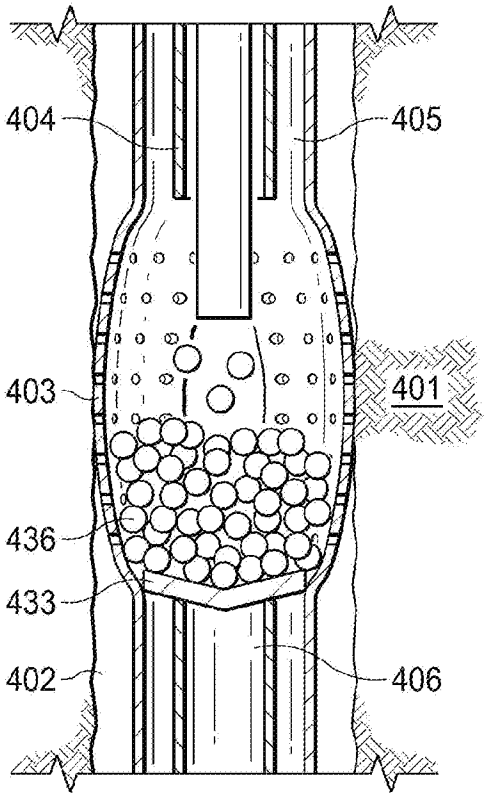

A heating device 438 is then run in the well (FIG. 1H). The heating device 438 on line 437 is used to melt the bismuth alloy material, which liquefies and easily flows into voids located in the wellbore and all around the casing fragments. This precludes the need for a squeeze step. Such devices can use thermite, or similar chemical, which is ignited and generates enough heat to melt the alloy. Bismuth alloy or any similar material with a high specific gravity and low viscosity can move other fluids and form a partial plug 499. This is repeated if needed for the volume of the cavity to form final plug 499 (See FIG. 1G-1L).

While a small amount of liquid alloy may leak at or near the blocking device, it typically cools quickly as it travels away from the heater, quickly solidifying and thus preventing further leaking. Typically, the heater will be deployed downhole prior to the downhole deployment of the solid alloy materials. Thus, the blocking device need not provide a perfect seal, as the cast-in-place material will improve the seal all around the blocking device. Above this bottom-most layer, the cast-in-place plug will provide a tight rock-to-rock seal.

Compatible heating tools are described in WO2011151271 and WO2014096858. Heating tools can be run on standard wireline, slick line or coil tubing. Compatible bismuth alloys are described in U.S. Pat. No. 7,290,609, and typically contain tin, bismuth lead, and the like. In general, bismuth alloys of approximately 50% bismuth exhibit little change of volume (1%) during solidification. Alloys containing more than this tend to expand during solidification and those containing less tend to shrink during solidification. Additional alloys are described in US20150368542, which describes a bismuth alloy comprises bismuth and germanium and/or copper. Additional alloys to plug wells or repair existing plugs in wells are described in U.S. Pat. No. 7,152,657; US20060144591; U.S. Pat. Nos. 6,828,531; 6,664,522; 6,474,414; and US20050109511.

The bismuth abandonment plugs can be pressure tested within hours (cement can require one or more days to set). Since a true metal-to-metal and metal-to-wall seals are made (no elastomers used), a permanent gas/liquid tight seal is created. Bismuth alloy plugs can be set in undamaged, damaged or even corroded casing. The alloy is inert, environmentally friendly and generally immune to corrosion and hydrogen sulfide or acid attacks.

Figure 1L:
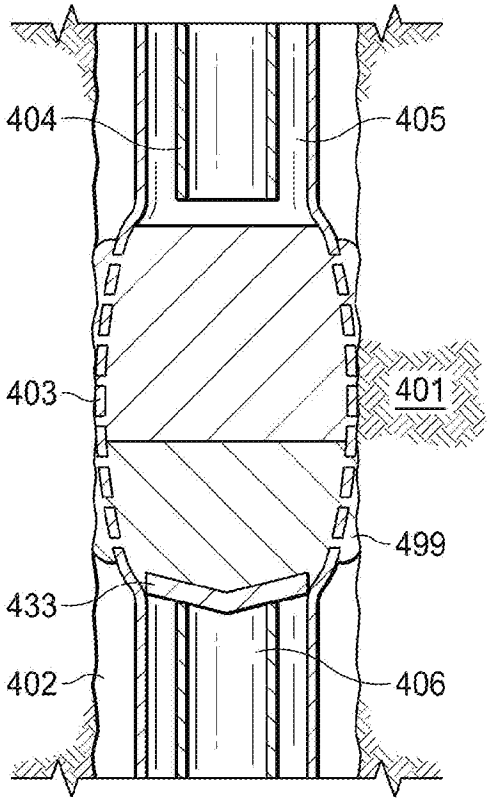
Figure 1K:
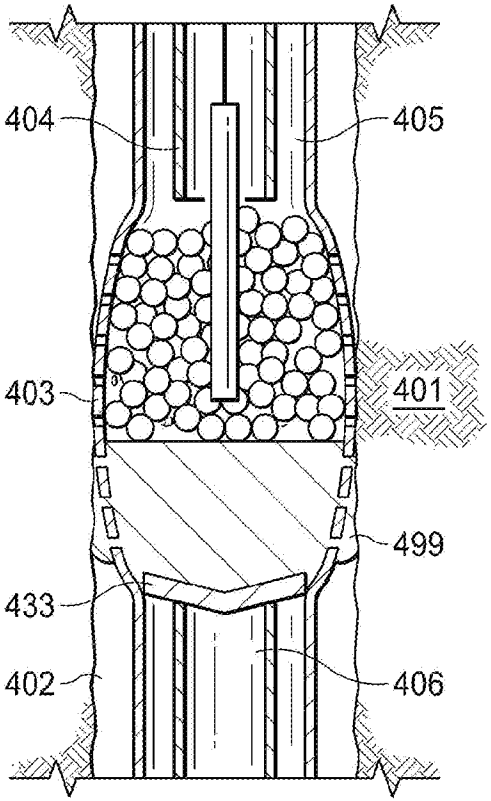
Figure 1J:
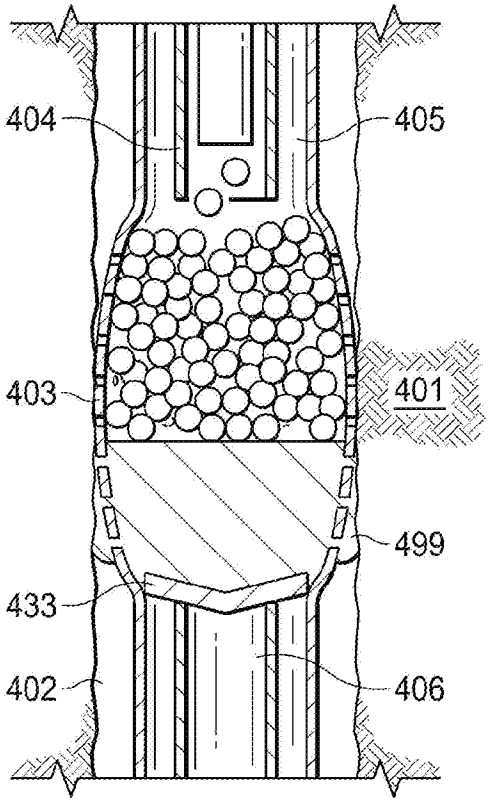
Figure 1N:
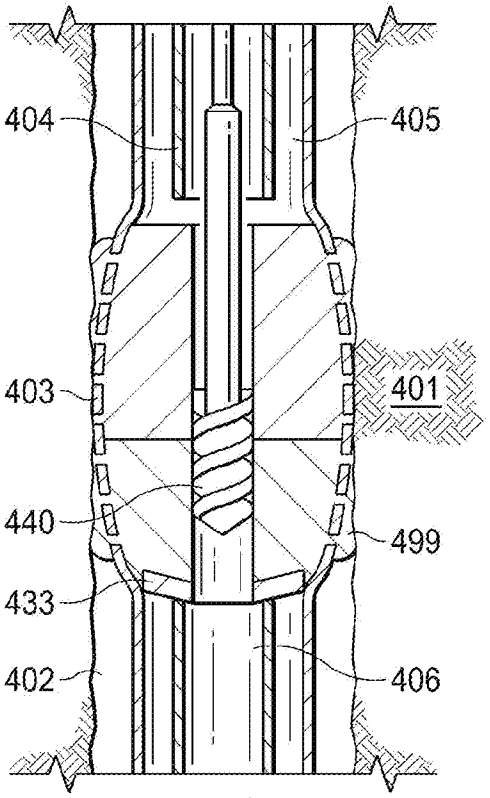
Figure 1M:
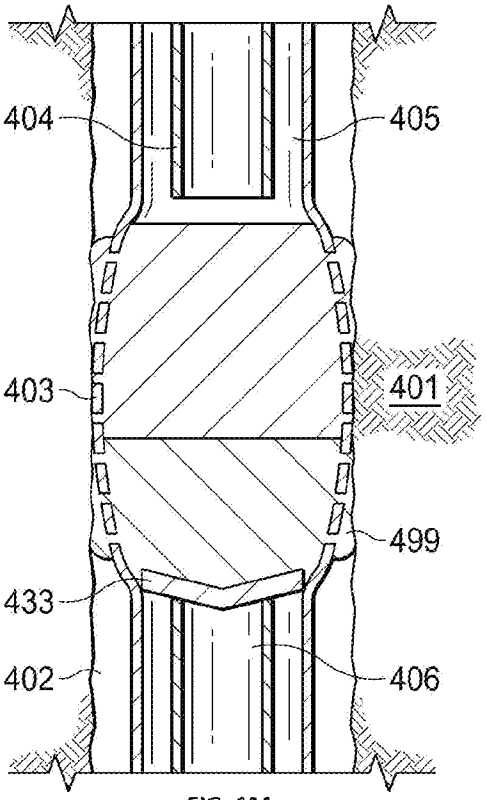

The cast-in-place operation can be repeated as needed to set more bismuth or other material until the cavity is filled to the desired level with the bismuth plug (FIG. 1L). As the alloy hardens, it expands and penetrates through the perforations and rupture in the outer casing to reach the reservoir wall (FIG. 1M). If necessary, a squeezing step can be applied as well. If the selected alloy expands sufficiently, squeezing step may be avoided.

If desired or required by regulations, a bore can be made in the plug and a logging tool run to confirm the placement and quality of the plug. A drilling tool 440 can be deployed with, e.g., coiled tubing and drills out plug 499 (FIG. 1N) to allow logging or other tool 441 on line 442 to log the plug (FIG. 1O) and confirm the quality. The logging tool 441 can measure several different characteristics including i) radioactivity if safe radioactive material is placed in the plug material; ii) degree of bonding to the formation using a sonic or ultrasonic cement bond logging tool; or iii) other types of logging.

Figure 1P:
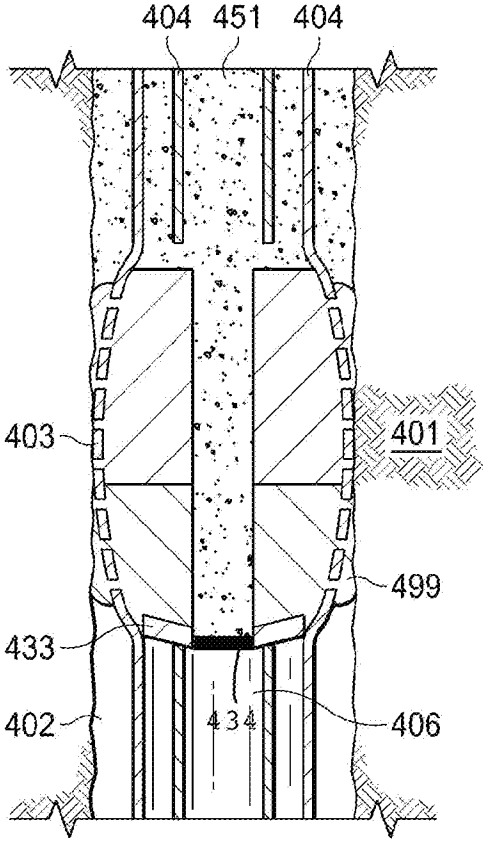
Figure 1O:
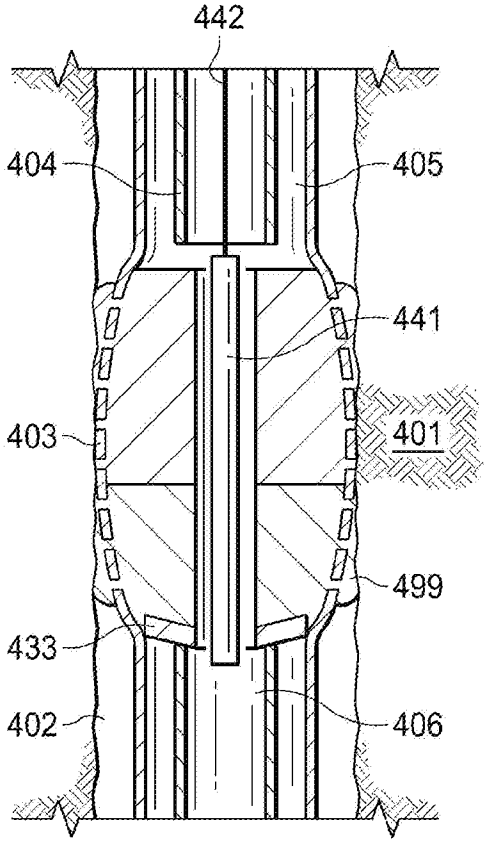

Once solid connection between the expanded casing and formation is confirmed, cement or alloy 451 or other material refills hole over plug 434 and may optionally provide a small overcap on plug 499 (FIG. 1P). This is preferably done by using an alloy plug set in similar way, but cement or other material can be placed. Cement can be placed by coil tubing, dump bailed, or other compatible means.

Figure 2C:
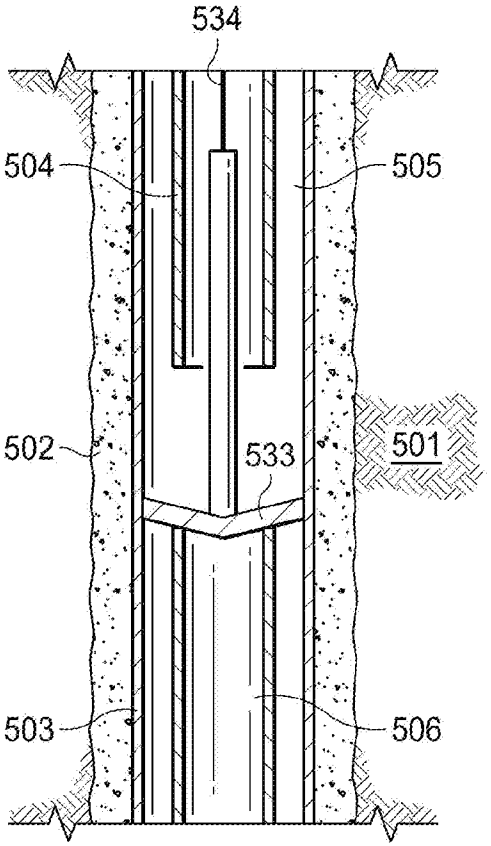
FIG. 2A, FIG. 2B, FIG. 2C, FIG. 2D, FIG. 2E, FIG. 2F, FIG. 2G, FIG. 2H, and FIG. 2I show an embodiment of the method, as applied to a section of well wherein the casing is cemented to the reservoir and the cement has been confirmed to have good quality. Here, a section of tubing (<2 m) and casing are milled, then a cast-in-place plug is set, largely as described in FIG. 1.
Figure 2B:
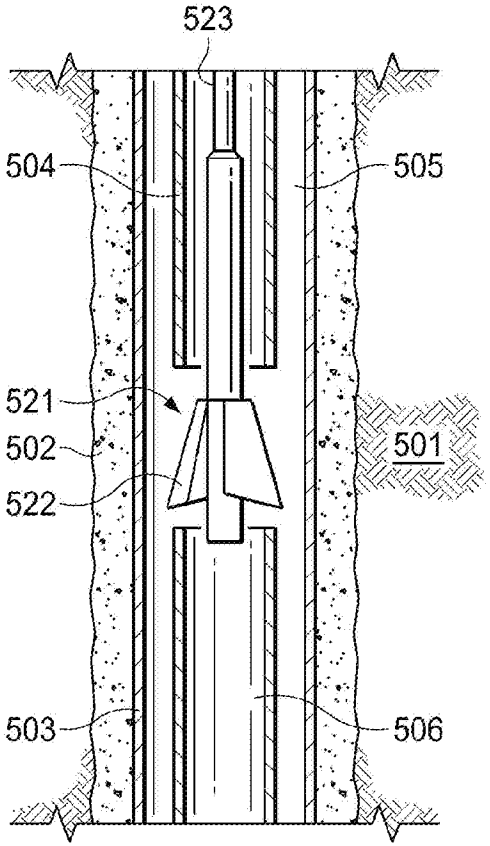
Figure 2A:
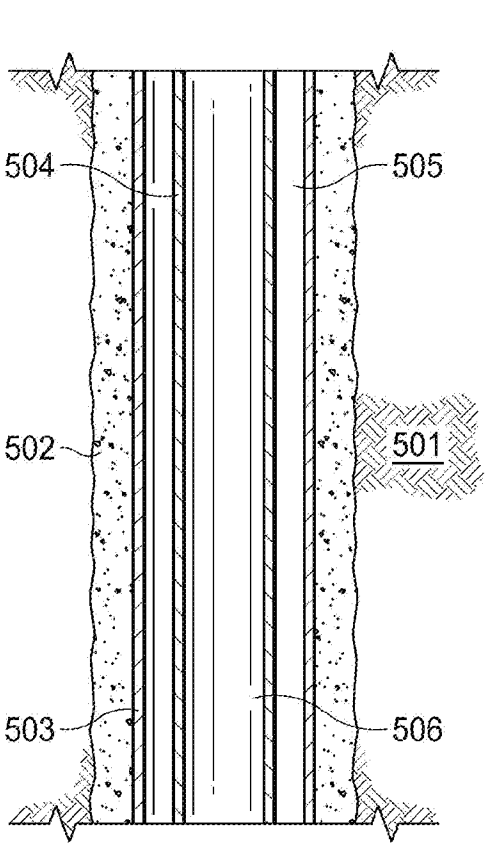

FIG. 2A-I illustrates another embodiment of the method. This method may be particularly useful when plugging a section that has good cement connection to the reservoir. Here, milling or cutting of the tubing is used to access the reservoir wall. Suitable means of accessing the reservoir wall include, but are not limited to, a milling tool run on wireline or coiled tubing, a jetting tool that uses water and abrasives, a plasma melting tool, a cutter, and the like. FIG. 2A illustrates a well before P&A operations. As shown, cement has already filled a space 502 between outer casing 503 and reservoir 501. Tubing 504 has an internal space 506 and an annular space 505 between the tubing 504 and casing 503.

Referring to FIG. 2B, a milling tool 521 with blades 522 on line 523 is deployed, via wireline or coiled tubing 523. Only a short section (<1-2 meters) will be milled, compared to the usual 50-100 meters or more in a traditional milling P&A operation. This reduces time needed for milling and/or swarf removal.

In one embodiment, an upward milling method is used. A compatible milling method is described in U.S. Pat. No. 6,679,328. Other compatible methods and tools include SwarfPak by West Group and Welltec tools. These devices use reverse flow, milling upwards and leaving the swarf downhole, thus eliminating swarf handling problems.

Figure 2F:
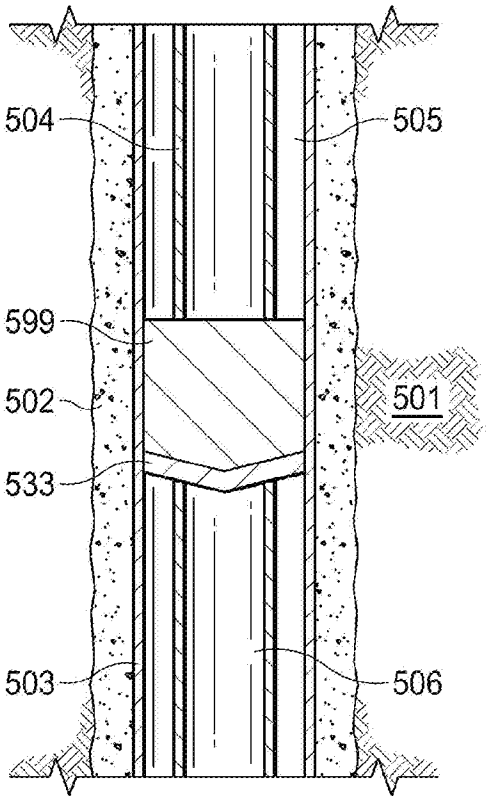
Figure 2E:
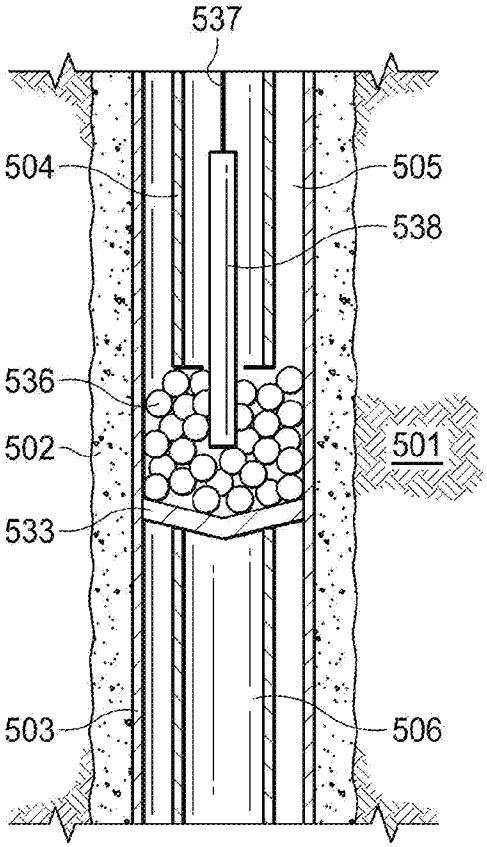
Figure 2D:
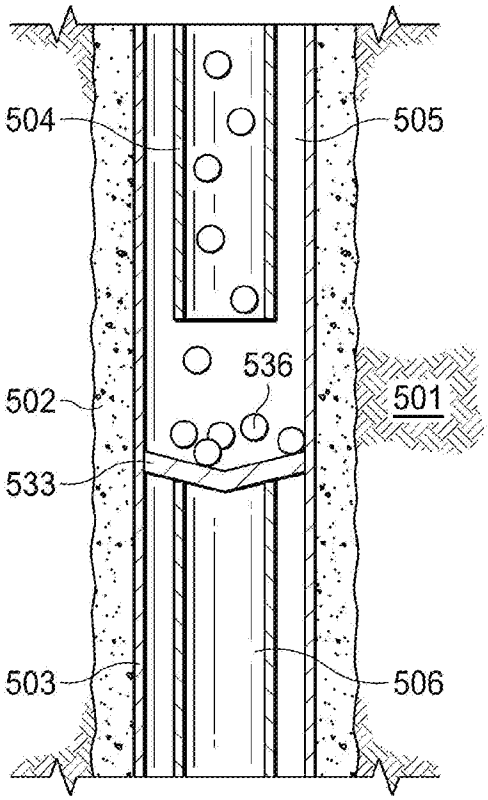

Referring to FIG. 2C, a plug, packer, basket or a similar device is lowered into the well to provide a base for a cast-in-place plug using the alloys described herein. Shown is inflatable basket 533 deployed via work string, wireline or coiled tubing 534. Next, alloy balls or pellets 536 are deployed into the well. These can be dropped from the surface or deployed via bailer. In FIG. 2E, heater 538 is deployed via work string, wireline or coiled tubing 537, to heat the alloy until it melts. This plug 599 is seen in FIG. 2F on top of basket 533. If needed, plug 599 can be tested by drilling it out with drill 540, using logging tool 541 deployed via line 542 in FIGS. 2G and 2H.

Figure 2I:
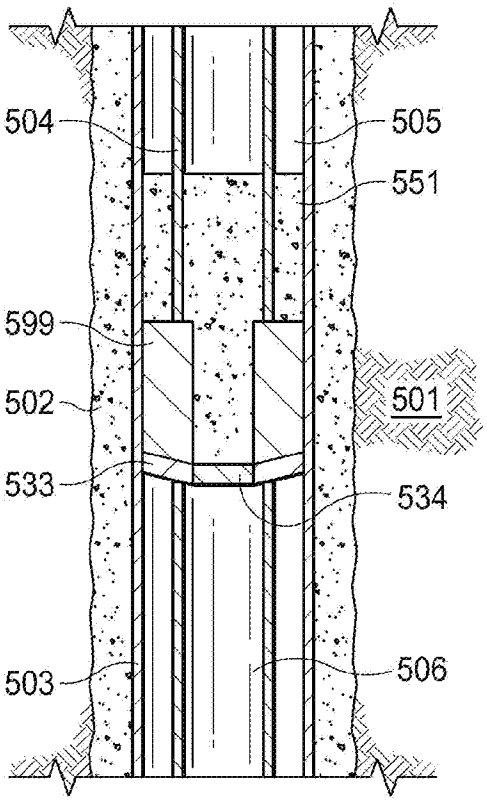
Figure 2H:
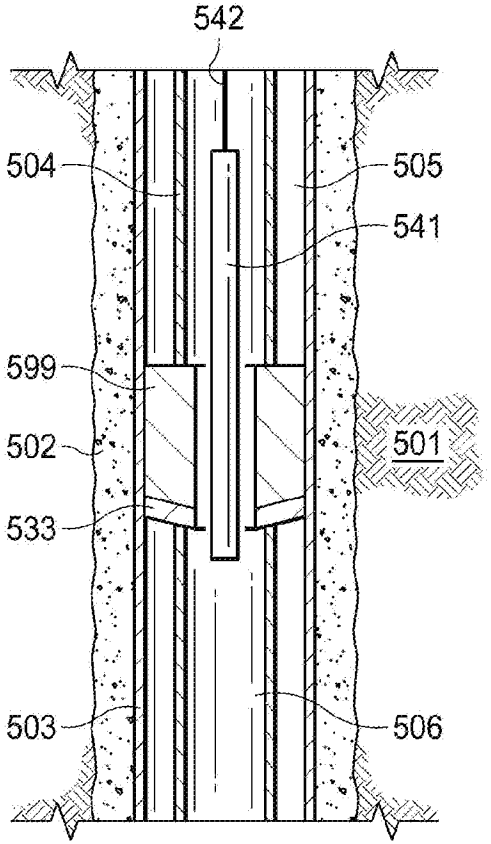
Figure 2G:
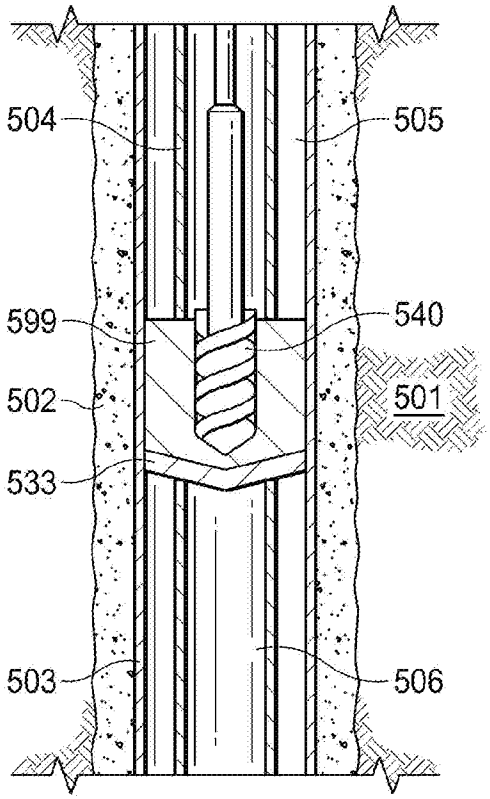

Finally, in FIG. 2I, cement 551 or other material refills the hole and further caps the alloy plug.

A variation of this plug setting process is to run heaters first. The disposable heaters can be placed on wireline, and the wireline retrieved once the heaters are activated when pellets in place. In this case the process is:

Establish a base to hold the pellets

Place multiple disposable heaters (aluminum) with remote control ignitors, heater top below tubing end Drop pellets and fill cavity Run ignition signal device on wireline and ignite heaters.

This variation allows the use of smaller diameter heaters to pass restrictions in the tubulars. Multiple heaters can be utilized to obtain required volume of thermite to melt the metal.

Figure 3C:
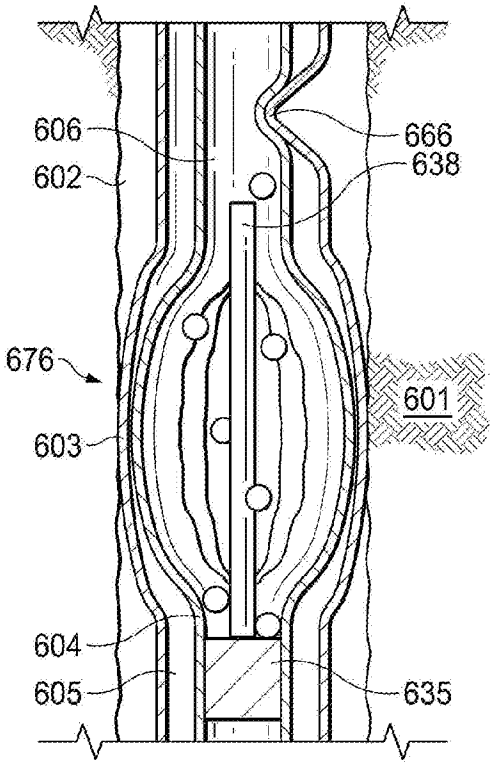
FIG. 3A, FIG. 3B, FIG. 3C, FIG. 3D, and FIG. 3E show yet another embodiment of the method, wherein a restriction is bypassed using the method of the invention.
Figure 3B:
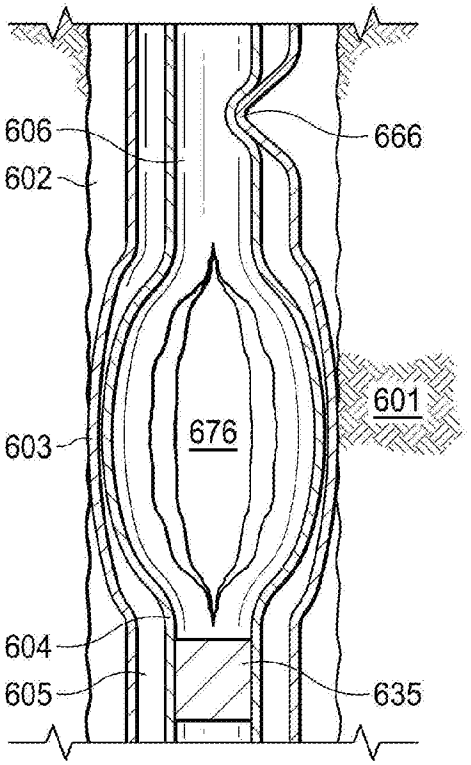
Figure 3A:
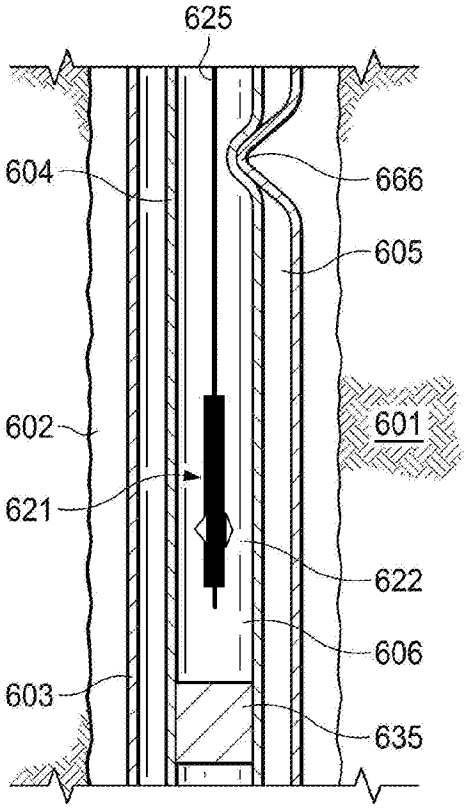
Figure 3E:
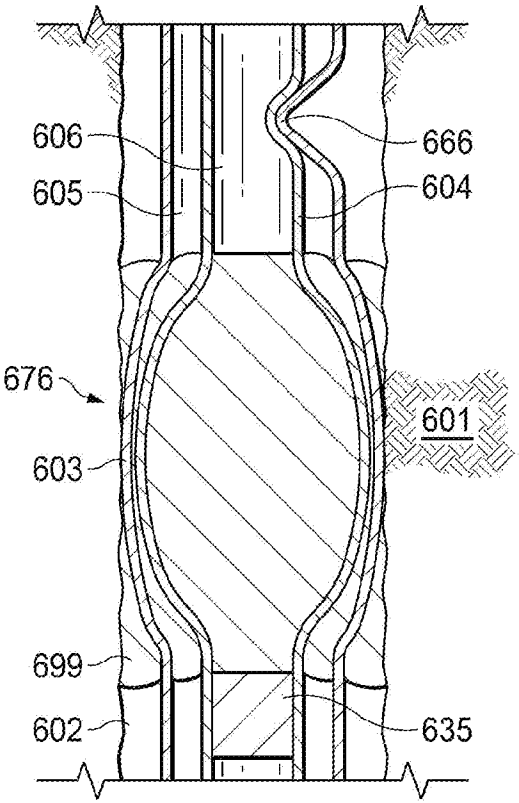
Figure 3D:
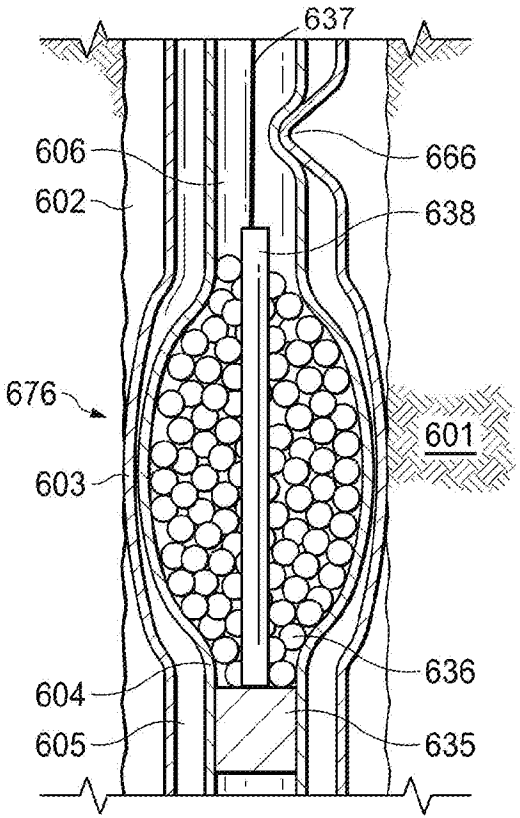

FIG. 3A-E shows another embodiment in which the method is used to plug a section of well with a significant deviation 666 in one or more of the casing. In FIG. 3A, the reservoir 601 is seen, along with annular space 602 between outer casing 603 and reservoir 601. Tubing 604 has an internal space 606 and an annular space 605 between the tubing 504 and casing 503.

Casing deformation tool 621 with blades 622 (on line 625) ruptures and expands casing, giving access to the annular space and reservoir. Since the tool is on a wireline or slickline, it can pass a deviated area or deviation 666. Plug, packer 635 or other device (here shown a plug) is installed and serves to catch bismuth pellets 636. Heater 638 on line 637 (which can be deployed even before the pellets, and left downhole) heats the pellets until they melt, thus filling all voids, and eventually solidifying to make plug 699. As above, the plug can be tested, and then further capped, as dictated by regulations.

Tests to confirm plug integrity include sonic or ultrasonic logging, positive pressure tests and negative pressure tests, inflow tests, and the like. To verify the position of a plug, top of cement (TOC) can be tagged. To tag TOC the work string or toolstring is slowly lowered until a reduction in weight is noticed as the string lands on the cement or other material plug. Plug location and top of cement is then confirmed. A similar test can be applied to an abandonment plug.

To test integrity of a plug, a load test can be performed. A load test is performed by lowering the toolstring onto the TOC, similar to the tagging operation. Then the driller applies weight onto the string and observes the outcome. If the weight on bit (WOB) readings increase as more weight is applied, and the position of the bit is constant, the plug is solid. The tag TOC and load test are often performed at the same time.

If the annular space outside the exterior casing was adequately cemented, this method could be modified, to milled or cut a section of tubing as described herein and then the cast-in-place abandonment plug used. However, if not cemented, or if the cement bond quality is poor, rupture and expansion or rupture and expansion with optional perforation is preferred. Rupture and expansion is typically sufficient to crumble any poor cement, which will typically fall further downhole, leaving a clean annular.

In some embodiments, multiple casings and/or tubulars can be ruptured and expanded. Plug setting would follow the same process.

The following documents are incorporated by reference in their entirety:

1. U.S. Pat. No. 6,474,414, "Plug for tubulars."
2. U.S. Pat. No. 6,664,522, "Method and apparatus for sealing multiple casings for oil and gas wells."
3. U.S. Pat. No. 6,679,328, "Reverse section milling method and apparatus."

4. U.S. Pat. No. 6,828,531, "Oil and gas well alloy squeezing method and apparatus."
5. U.S. Pat. No. 6,923,263, "Well sealing method and apparatus."
6. U.S. Pat. No. 7,152,657, "In-situ casting of well equipment."
7. U.S. Pat. No. 7,290,609, "Subterranean well secondary plugging tool for repair of a first plug."
8. US20060144591, "Method and apparatus for repair of wells utilizing meltable repair materials and exothermic reactants as heating agents."
9. US20100006289, "Method and apparatus for sealing abandoned oil and gas wells."
10. US20130333890, "Methods of removing a wellbore isolation device using a eutectic composition."
11. US20130087335, "Method and apparatus for use in well abandonment."
12. US20150345248, US20150368542, US20160145962, "Apparatus for use in well abandonment."
13. US20150368542, "Heat sources and alloys for us in down-hole applications."
14. US20150053405, "One trip perforating and washing tool for plugging and abandoning wells."
15. US-2018-0216437, "Through Tubing P&A with Two-Material Plugs."
16. US-2018-0094504, "Nano-Thermite Well Plug."
17. US-2018-0148991, "Tool for Metal Plugging or Sealing of Casing."

The invention claimed is:

1. A through-tube method of plugging a hydrocarbon well, comprising:

placing a wireline lubricator on top of a Christmas tree;

deploying a casing deformation tool downhole without removing the Christmas tree to rupture and expand both an inner tubular and exterior casing at a section of well to be plugged wherein said casing deformation tool forces blades out of the tool housing thereby expanding, and rupturing the inner tubular and exterior casing giving access to the annulus surrounding the casing, thereby forming an expanded cavity;

deploying a blocking device downhole to block a bottom of said section of well to be plugged;

deploying bismuth alloy pellets downhole onto said blocking device to fill an area to be plugged;

deploying a heater downhole to heat said bismuth alloy pellets to form liquid bismuth alloy; and allowing said liquid bismuth alloy to solidify and expand to form a cast-in-place plug that fills said section of well to be plugged.

2. The method of claim 1, wherein a 1-5 meter cast-in-place plug is formed.

3. The method of claim 1, wherein said ruptured and expanded tubular and exterior casing are perforated.

4. The method of claim 1, wherein a wireline or coiled tubing deployed milling tool is used to mill 1-5 meter of said inner tubular and said exterior casing.

5. The method of claim 1, wherein produced swarf is removed by circulation, chemical dissolution, or both.

6. The method of claim 1, wherein a milling tool uses upward milling and swarf falls downhole.

7. The method of claim 1, wherein the heater is deployed prior to deploying the bismuth alloy pellets.

8. The method of claim 1, wherein said blocking device is a plug, a packer, or a basket.

9. A method of plugging a hydrocarbon well, comprising:

placing a wireline lubricator on top of a Christmas tree;

deploying a casing deformation tool downhole without removing the Christmas tree to both rupture and expand an inner tubular and an exterior casing at a 1-5 m section of well to be plugged by rock-to-rock plugging wherein said rupturing tool forces blades out of the tool housing thereby expanding and rupturing the inner tubular and exterior casing giving access to the annulus surrounding the casing, thereby forming an expanded cavity;

deploying, a blocking device downhole to block a bottom of said section of well to be plugged;

deploying bismuth alloy pellets downhole onto said blocking device;

heating said bismuth alloy pellets to allow said bismuth alloy pellets to liquefy;

allowing said liquefied bismuth alloy to solidify and expand to fill said section of well to be plugged or a portion thereof; and continuing to deploy bismuth alloy pellets downhole onto said solidified bismuth alloy, heating said bismuth alloy pellets to allow said bismuth alloy pellets to liquefy, and allowing said liquified bismuth alloy to solidify and expand to fill said section of well until said 1-5 m section of well is filled with a bismuth alloy rock-to-rock plug.

10. The method of claim 9, wherein said ruptured and expanded tubular and exterior casing are perforated.

11. The method of claim 9, wherein a wireline or coiled tubing deployed milling tool is used to mill 1-5 meter of said inner tubular and said exterior casing.

12. The method of claim 9, wherein produced swarf is removed by circulation, chemical dissolution, or both.

13. The method of claim 9, wherein a milling tool uses upward milling and swarf falls downhole.

14. The method of claim 9, wherein the heater is deployed prior to deploying the bismuth alloy pellets.

15. The method of claim 9, wherein said blocking device is a plug, a packer, or a basket.

16. A method of plugging and abandoning a hydrocarbon well, comprising:

placing a wireline lubricator on top of a Christmas tree, deploying a casing deformation tool downhole without removing the Christmas tree to rupture and expand inner and outer tubulars at a section of well to be plugged wherein said rupturing tool forces blades out of the tool housing thereby expanding and rupturing the inner tubular and exterior casing giving access to the annulus surrounding the casing, thereby forming an expanded cavity;

deploying a perforating tool downhole to perforate said section of well to be plugged;

deploying a blocking device downhole to block a bottom of said section of well to be plugged;

deploying bismuth alloy pellets downhole onto said blocking device to fill said section;

heating said bismuth alloy pellets until said bismuth alloy pellets liquefy;

allowing said liquefied bismuth alloy to solidify and expand to fill said section;

deploying a cement log downhole to confirm that said bismuth alloy plug has good contact with a wall of said reservoir at said section of well to be plugged;

removing the Christmas tree from said well; and closing and abandoning said well.

17. The method of claim 16, wherein a 1-5 meter bismuth alloy plug is formed.

18. The method of claim 16, wherein a casing deformation tool is used in step to rupture and expand said inner tubular and said exterior casing.

19. The method of claim 16, wherein said ruptured and expanded tubular and exterior casing are perforated.

20. The method of claim 16, wherein a wireline or coiled tubing deployed milling tool is used to mill 1-5 meter of said inner tubular and said exterior casing.

21. The method of claim 16, wherein produced swarf is removed by circulation, chemical dissolution, or both.

22. The method of claim 16, wherein a milling tool uses upward milling and swarf falls downhole.

23. The method of claim 16, wherein the heater is deployed prior to deploying the bismuth alloy pellets.

24. The method of claim 16, wherein said blocking device is a plug, a packer, or a basket.

* * * * *